United States Patent [19]

Ward

[11] 4,205,258

[45] May 27, 1980

[54] INTERNAL SHORTING FUSE FOR A HIGH-INTENSITY DISCHARGE LAMP

[75] Inventor: Patrick C. Ward, Sparta, N.J.

[73] Assignee: Westinghouse Electric Corp., Pittsburgh, Pa.

[21] Appl. No.: 22,404

[22] Filed: Mar. 21, 1979

[51] Int. Cl.[2] ..... H01J 7/44

[52] U.S. Cl. ..... 315/73; 315/75

[58] Field of Search ..... 315/73, 74, 75

[56] References Cited

U.S. PATENT DOCUMENTS

| | | | |
|---|---|---|---|
| 2,950,417 | 8/1960 | Breeding et al. | 315/75 |
| 3,767,965 | 10/1973 | Collins et al. | 315/75 |
| 3,849,691 | 11/1974 | Collins | 315/184 X |

*Primary Examiner*—Alfred E. Smith
*Assistant Examiner*—Charles F. Roberts
*Attorney, Agent, or Firm*—R. S. Lombard

[57] ABSTRACT

A high-intensity discharge lamp having an arc tube which is enclosed by and supported within a light-transmitting outer envelope which is spaced from the arc tube. The outer envelope enclosing a hard vacuum. Electrical lead-in means are sealed through the arc tube connected to the electrodes. Electrical adapter means are affixed to the outer surface of the protective envelope to facilitate electrical connection for the lamp to a source of electrical power. A pair of electrical conductors electrically connect the electrical adapter means to the electrical lead-in means. Fuse means is provided. The fuse means has a fusible element extending from one of the electrical conductors and separated from and encircling an insulating sleeve means carried about the other of the electrical conductors, so that the spacing therebetween constitutes the shortest gap within the envelope between opposite current-carrying components. The hard vacuum enclosed by the outer envelope is obtained by flashing barium getter means.

Improved insulating sleeve means is provided having an outer hollow elongated sleeve member having insulating spacing means integral therewith and projecting inwardly from the inner surface thereof and positioned a predetermined distance inwardly from the ends of the sleeve member. The insulating spacing means is provided with a bore to receive and encircle the other electrical conductor in electrically insulative relationship to prevent the outer elongated sleeve member from contacting the other electrical conductor, whereby barium flashed during gettering that may be adhered to the surface of the outer hollow sleeve member is prevented from causing an electrical short of the arc tube.

6 Claims, 4 Drawing Figures

INTERNAL SHORTING FUSE FOR A HIGH-INTENSITY DISCHARGE LAMP

BACKGROUND OF THE INVENTION

This invention relates to high-intensity discharge lamps, of the type comprising an arc tube enclosed within an outer envelope, and, more particularly, to a high-intensity discharge lamp having a fuse to prevent the formation of destructive power arcs within the outer envelope.

One such lamp is described in U.S. Pat. No. 3,767,965, dated Oct. 23, 1973, issued to Collins et al. The Collins lamp utilizes a self-shorting arcing fuse to prevent the possibility of a destructive power arc forming within the outer envelope if air should leak into the outer envelope or should the arc tube fail resulting in a partial pressure of gas in the outer envelope. The fuse is provided within the outer envelope to extinguish such an arc safely and end the life of the lamp.

SUMMARY OF THE INVENTION

There is provided a high-intensity discharge lamp combination, wherein the high-intensity discharge lamp comprises an arc tube which is enclosed by and supported within a light-transmitting outer envelope which is spaced from the arc tube. The outer envelope encloses a hard vacuum. The arc tube encloses a discharge sustaining filling such as sodium plus mercury and has electrodes oppositely positioned therein proximate the ends thereof. Electrical lead-in means are sealed through the arc tube and connected to the electrodes. Electrical adapter means are affixed to the outer surface of the protective envelope to facilitate electrical connection for the lamp to a source of electrical power. A pair of electrical conductors electrically connect the electrical adapter means to the electrical lead-in means.

Fuse means comprising a fusible element which extends from one of the electrical conductors and is separated from and encircles an insulating sleeve means carried about the other of the electrical conductors. The spacing between the fusible element and the other of the electrical conductors as determined by the insulating sleeve means constitutes the shortest gap within the envelope between opposite current-carrying components so that any arc occurring between opposite current-carrying components will occur proximate the insulating sleeve means and melt the insulating sleeve means and fuse the fusible element to the other electrical conductor and thus render the lamp inoperative. During lamp fabrication, barium getter means are flashed in the protective outer envelope to ensure a hard vacuum.

The improvement comprises an improved insulating sleeve means comprising an outer hollow elongated sleeve member having insulating spacing means integral therewith and projecting inwardly from the inner surface thereof and positioned a predetermined distance inwardly from the ends of said sleeve member. The spacing means is provided with a bore to receive and encircle the other electrical conductor in electrically insulative relationship to prevent the outer hollow elongated sleeve member from contacting the other electrical conductor, whereby barium flashed during gettering that may be adhered to the surface of the outer hollow elongated sleeve member is prevented from causing an electrical short of the arc tube.

BRIEF DESCRIPTION OF THE DRAWINGS

Figure 1:
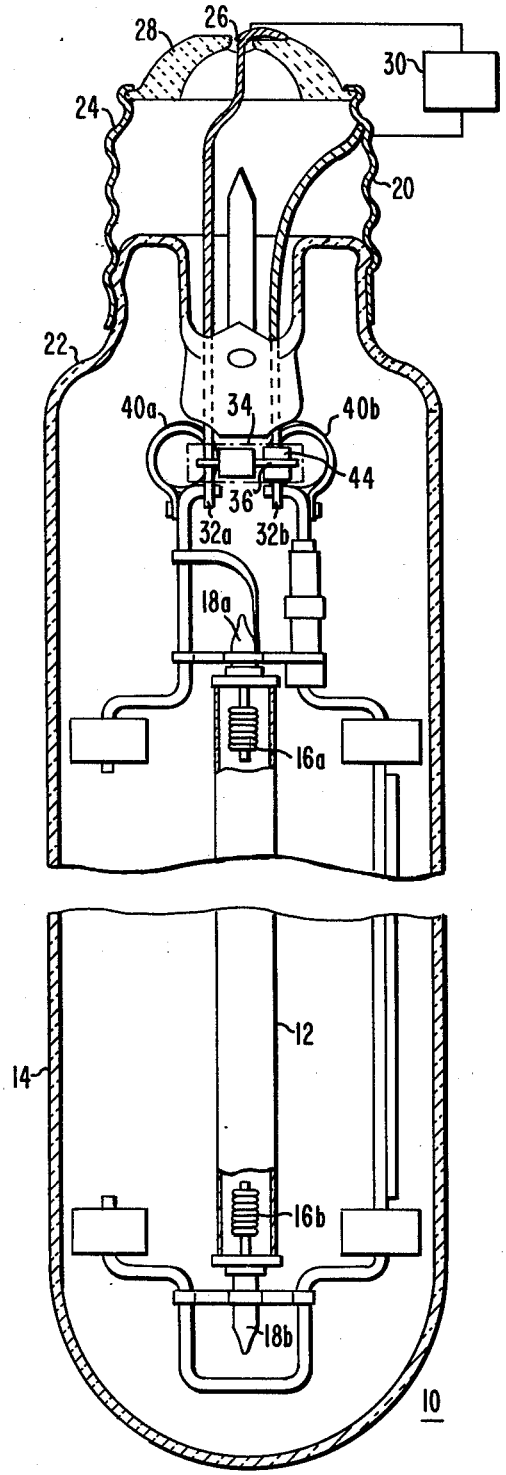
In FIG. 1 is shown an elevational view of a high-intensity discharge lamp, partly in section.

In FIG. 1 is shown a high-intensity discharge lamp 10, which as shown in FIG. 1 is a high-pressure sodium vapor lamp. The lamp 10 comprises an arc tube 12 which is enclosed by and supported within a light-transmitting outer envelope made of a high temperature glass such as borosilicate glass and which is spaced from the arc tube 12. The outer envelope 14 encloses a hard vacuum. The arc tube 12 encloses a discharge sustaining filling, which in the case of a high-pressure sodium vapor lamp, typically consists of an inert gas, such as xenon, and a sodium-mercury amalgam. The arc tube 12 has electrodes **16*a*, 16*b*** operatively positioned therein proximate the ends thereof.

Electrical lead-in means **18*a*, 18*b* are sealed through the arc tube and connected to the electrodes 16*a*, 16*b*. Electrical adapter means 20 is affixed to the outer surface 22 of the protective envelope. The electrical adapter means typically comprises a metallic shell portion 24, a metallic eyelet 26 separated by a glass or ceramic insulator 28. Electrical adapter means 20 facilitate the electrical connection of the lamp 10 to a source 30 of electrical power. A pair of electrical conductors 32*a*, 32*b* connect the electrical adapter means 20 to the electrical lead-in means 18*a*, 18*b***.

Figure 3:
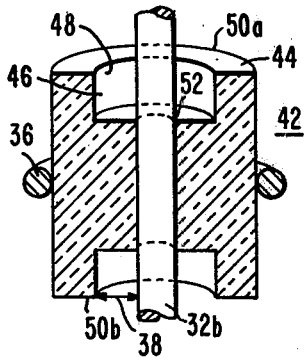
In FIG. 3 is shown an enlarged sectional view of the improved insulating sleeve means; and In FIG. 4 is shown an enlarged sectional view of an alternative improved insulating sleeve means.
Figure 4:
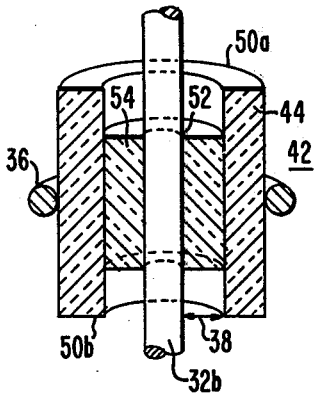

Fuse means 34 are provided, which comprise a fusible element 36 which extends from one of the electrical conductors **32*a* and is separated from and encircles an insulating sleeve means 42 carried about the other of the electrical conductors 32*b*, with the spacing 38 between the fusible element 36 and the other of the electrical conductors 32*b* as determined by the insulating sleeve means, more clearly shown in FIGS. 3 and 4, constituting the shortest gap within the envelope 14 between opposite current-carrying components. Any arc occurring between opposite current-carrying components will occur proximate the insulating sleeve means 42 and melt the insulating sleeve means 42 and fuse the fusible element 36 to the other electrical conductor 32*b* and thus render the lamp 10 inoperative. The fuse means 34 is utilized especially in high wattage lamps, such as 1000 watt high-pressure sodium vapor lamps, to prevent destructive arcing if gas is present in the outer envelope. The hard vacuum enclose and the outer envelope 14 is obtained by flashing barium getter means 40*a*, 40*b*. Barium getter means 40*a*, 40*b* are affixed to and retained by the electrical lead-in means 18*a*, 18*b*. The lamp 10** as described thus far is generally conventional.

Figure 2:
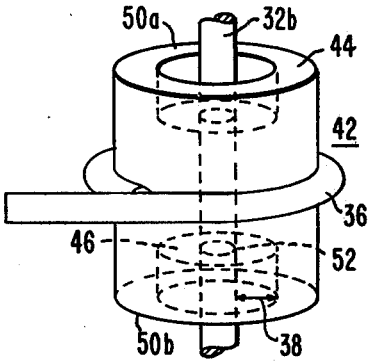
In FIG. 2 is shown an enlarged isometric view of the improved insulating sleeve means.

Referring to FIGS. 2 and 3, there is provided an improved insulating sleeve means 42, preferably made of glass, separating the fusible element 36 from the other of the electrical conductors **32*b*. The improved sleeve means 42 comprises an outer hollow elongated sleeve member 44, about which the fusible element 36 is wrapped, having insulating spacing means 46 integral therewith and projecting inwardly from the inner surface 48 thereof and positioned a predetermined distance inwardly from the ends 50***a*, 50*b* of the outer sleeve member 44. The spacing means 46 is provided with a bore 52 to receive and encircle the other electrical conductor 32*b* in electrically insulative relationship to prevent the outer hollow elongated sleeve member 44 from contacting the other electrical conductor 32*a*, whereby barium flashed during gettering that may be adhered to the surface of the outer elongated sleeve member 44 is prevented from causing an electrical short of the arc tube which can occur in the absence of gas in the space between outer envelope 14 and the tubes. The presence of barium on the outer glass sleeve 44 without the inclusion of the insulating means 46 as described may give rise to localized arcing within the lamp 10 that eventually may lead to formation of a destructive arc occurring within the outer envelope 14.

An alternative embodiment is shown in FIG. 4, in which the insulating means 42 comprises the outer hollow elongated sleeve member 44 and an inner hollow elongated sleeve member 54. The inner sleeve member 54 is positioned a predetermined distance inwardly from the ends 50*a*, 50*b* of the outer sleeve member 44. The outer sleeve member 44 is in contact with the encircling fusible element 36. The inner sleeve member 54 is provided with a bore 52 to receive and encircle the other electrical conductor 32*b* in electrically insulative relationship in the same manner as described above for the insulating spacing means 46.

In practicing the invention, a 1000 watt high-pressure sodium-vapor lamp was constructed utilizing an insulating means 42 composed of borosilicate glass. The outer sleeve member 44 was made from glass tubing having an inside diameter of 0.098 millimeter and an outside diameter of 0.149 millimeter and a length of 6.0 millimeters and the inner sleeve was made from lead glass tubing having an outside diameter of 0.095 millimeter and a length of 4.0 millimeters. It was found that the insulating spacing means 46 or, alternatively, the inner sleeve member 54 should be positioned at least 1 millimeter from the ends of the outer sleeve member 44. In testing this lamp, no unwanted arcing was encountered.

I claim:

1. In combination with a high-intensity discharge lamp comprising an arc tube which is enclosed by and supported within a light-transmitting outer envelope which is spaced from said arc tube, said outer envelope enclosing a hard vacuum, said arc tube enclosing a discharge-sustaining filling and having electrodes operatively positioned therein proximate the ends thereof, electrical lead-in means sealed through said arc tube and connected to said electrodes, electrical adapter means affixed to the outer surface of said protective envelope to facilitate electrical connection of said lamp to a source of electrical power, a pair of electrical conductors electrically connecting said electrical adapter means to said electrical lead-in means, fuse means comprising a fusible element extending from one of said electrical conductors and separated from and encircling an insulating sleeve means carried about the other of said electrical conductors with the spacing between said fusible element and the other of said electrical conductors as determined by said insulating sleeve means constituting the shortest gap within said envelope between opposite current-carrying components so that any arc occurring between said current-carrying components will occur proximate said insulating sleeve means and melt said insulating sleeve means and fuse said fusible element to said other electrical conductor and thus render said lamp inoperative, and the hard vacuum enclosed by said outer envelope having been obtained by flashing barium getter means, the improvement which comprises:

an improved insulating sleeve means separating said fusible element from the other of said electrical conductors, said improved insulating sleeve means comprising an outer hollow elongated sleeve member, said outer hollow elongated sleeve member about which said encircling fusible element is wrapped, said outer hollow elongated sleeve member having insulating spacing means integral therewith and projecting inwardly from the inner surface thereof and positioned a predetermined distance inwardly from the ends of said outer sleeve member, said insulating spacing means provided with a bore to receive and encircle said other electrical conductor in electrically insulative relationship to prevent said outer hollow elongated sleeve member from contacting said other electrical conductor, whereby barium flashed during gettering that may be adhered to the surface of said outer sleeve member is prevented from causing an electrical short of said arc tube.

2. The lamp of claim 1, wherein said improved insulating sleeve means is made of glass.

3. The lamp of claim 1, wherein said insulating spacing means is positioned at least 1 millimeter inwardly from the ends of said outer sleeve member.

4. In combination with a high-intensity discharge lamp comprising an arc tube which is enclosed by and supported within a light-transmitting outer envelope which is spaced from said arc tube, said outer envelope enclosing a hard vacuum, said arc tube enclosing a discharge-sustaining filling and having electrodes operatively positioned therein proximate the ends thereof, electrical lead-in means sealed through said arc tube and connected to said electrodes, electrical adapter means affixed to the outer surface of said protective envelope to facilitate electrical connection of said lamp to a source of electrical power, a pair of electrical conductors electrically connecting said electrical adapter means to said electrical lead-in means, fuse means comprising a fusible element extending from one of said electrical conductors and separated from and encircling an insulating sleeve means carried about the other of said electrical conductors with the spacing between said fusible element and the other of said electrical conductors as determined by said insulating sleeve means constituting the shortest gap within said envelope between opposite current-carrying components so that any arc occurring between said current-carrying components will occur proximate said insulating sleeve means and melt said insulating sleeve means and fuse said fusible element to said other electrical conductor and thus render said lamp inoperative, and the hard vacuum, etc., components, and the hard vacuum enclosed by said outer envelope having been obtained by flashing barium getter means, the improvement which comprises:

an improved insulating means separating said fusible element from the other of said electrical conductors, said insulating means comprising an outer hollow elongated sleeve member and an inner hollow elongated sleeve member positioned a predetermined distance inwardly from the ends of said outer sleeve member, said outer sleeve member about which said encircling fusible element is wrapped, said inner sleeve member provided with a bore to receive and encircle said other electrical conductor in electrically insulative relationship to prevent said outer hollow elongated sleeve member from contacting said other electrical conductor, whereby barium flashed during gettering that may be adhered to the surface of said outer elongated sleeve member is prevented from causing an electrical short of said arc tube.

5. The lamp of claim 4, wherein said improved insulating sleeve means is made of glass.

6. The lamp of claim 4, wherein said inner hollow elongated sleeve member is positioned at least 1 millimeter inwardly from the ends of said outer sleeve member.

* * * * *